US006857857B2

(12) United States Patent
Dovey et al.

(10) Patent No.: US 6,857,857 B2
(45) Date of Patent: Feb. 22, 2005

(54) RECIPROCATING MACHINES

(75) Inventors: Stephen J. Dovey, West Sussex (GB); Gerald R. Shelley, East Sussex (GB); Ian D. Stones, West Sussex (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/824,074

(22) Filed: Apr. 2, 2001

(65) Prior Publication Data

US 2003/0219341 A1 Nov. 27, 2003

(30) Foreign Application Priority Data

Apr. 4, 2000 (GB) ..... 0008281

(51) Int. Cl.[7] ..... F04B 49/06; F04B 17/03
(52) U.S. Cl. ..... 417/44.1; 417/63; 417/415
(58) Field of Search ..... 417/44.1, 44.11, 417/45, 15, 17, 410.1, 415, 63, 418, 417

(56) References Cited

U.S. PATENT DOCUMENTS

| | | | | |
|---|---|---|---|---|
| 2,964,272 A | * | 12/1960 | Olson | 248/550 |
| 3,910,729 A | | 10/1975 | Jepson et al. | |
| 4,390,321 A | | 6/1983 | Langlois et al. | |
| 4,843,951 A | * | 7/1989 | Bruggen et al. | 92/5 R |
| 4,985,015 A | | 1/1991 | Obermann et al. | |
| 5,059,097 A | | 10/1991 | Okazaki et al. | |
| 5,062,399 A | | 11/1991 | Nagakura et al. | |
| 5,318,521 A | | 6/1994 | Siettenmark | |
| 5,477,149 A | | 12/1995 | Spencer et al. | |
| 5,846,056 A | | 12/1998 | Dhindsa et al. | |
| 5,947,693 A | * | 9/1999 | Yang | 417/45 |
| 6,176,683 B1 | * | 1/2001 | Yang | 417/44.1 |
| 6,536,326 B2 | * | 3/2003 | Unger et al. | 91/361 |
| 6,663,348 B2 | * | 12/2003 | Schwarz et al. | 417/12 |
| 2003/0118460 A1 | * | 6/2003 | Lillie et al. | 417/415 |

FOREIGN PATENT DOCUMENTS

| | | | |
|---|---|---|---|
| EP | 0 793 019 A2 | | 2/1997 |
| GB | 2 278 405 | | 11/1994 |
| JP | 6-73879 | * | 3/1994 |
| JP | 11-324911 | * | 11/1999 |

OTHER PUBLICATIONS

Matsumura et al., JP 11–324911, Computer Translation, Nov. 1999.
Database WPI, Section PQ, Week 200020, Derwent Publications Ltd., London, GB; Class Q56, AN 2000–224962, XP002238999 & BR 9 901 136 A (LG Electronics Inc), Jan. 11, 2000 *abstract*.
Declaration of Stephen Dovey.
Declaration of Carl Watkinson.
Declaration of David Steele.

* cited by examiner

*Primary Examiner*—Charles G. Freay
(74) *Attorney, Agent, or Firm*—Joshua L. Cohen; Wan Yee Cheung; Ira Lee Zebrak

(57) ABSTRACT

A reciprocating machine such as a vacuum pump includes a cylinder in which a reciprocating piston is disposed for reciprocating movement. A variable voltage driver is provided for driving the piston and a vibration sensor is provided for sensing contact between the piston and ends of the cylinder. A controller interconnects the sensor and driver to control movement of the driver and piston to maximize piston stroke and reduce if not eliminate contacting of the piston with the cylinder.

7 Claims, 1 Drawing Sheet

RECIPROCATING MACHINES

BACKGROUND OF THE INVENTION

FIELD OF THE INVENTION

The present invention relates to reciprocating machines such as vacuum pumps which incorporate a reciprocating piston and control systems therefore.

Vacuum pumps incorporating a reciprocating piston mode of operation are known which have an electromagnetic actuator arrangement driving a piston for the pump.

In European patent publication no. 0793019 there is described a vacuum pump which uses a multi-stage reciprocating piston mode of operation in which piston reciprocation is effected by an electromagnetic drive means and a counter-acting spring means and in which the pump stages are connected in series between a pump inlet and a pump outlet such that, in use, gas being transferred through the pump passes through the stages in turn.

OBJECTS AND SUMMARY OF THE INVENTION

It is an object of the present invention to provide a machine and more particularly, a vacuum pump incorporating a reciprocating piston for which a vibration sensor is used to control the piston stroke and thus avoid over driving the piston for the machine/vacuum pump.

It is another object of the present invention to provide a control system for use with a piston in for example a vacuum pump to control the stroke of the piston within a cylinder of the pump.

It is another object of the present invention to provide a closed loop central system for a machine such as a vacuum pump.

According to the present invention, a machine consists of a cylinder closed at both ends, one of the ends adapted to receive a piston, the piston mounted for reciprocable movement within the cylinder between each end, means for driving the piston, and a vibration sensor for sensing any contact between the piston and the ends of the cylinder.

In a preferred embodiment of the present invention, the machine is a vacuum pump, the vibration sensor is a piezoelectric device and the driving means includes an electro-magnet.

Preferably, the machine is driven by a closed loop control system including the vibration sensor, a variable drive and an electronic circuit which is used to analyze a vibration sensor output signal to determine the drive voltage for the piston.

BRIEF DESCRIPTION OF THE DRAWING

An embodiment of the invention will now be described by way of example, reference being made to the FIGURE of the accompanying diagrammatic drawing which is a schematic illustrating the relationship between the drive means, reciprocating piston, vibration sensor and controller of a machine according to the present invention.

DESCRIPTION OF THE PREFERRED EMBODIMENTS

Figure 1:
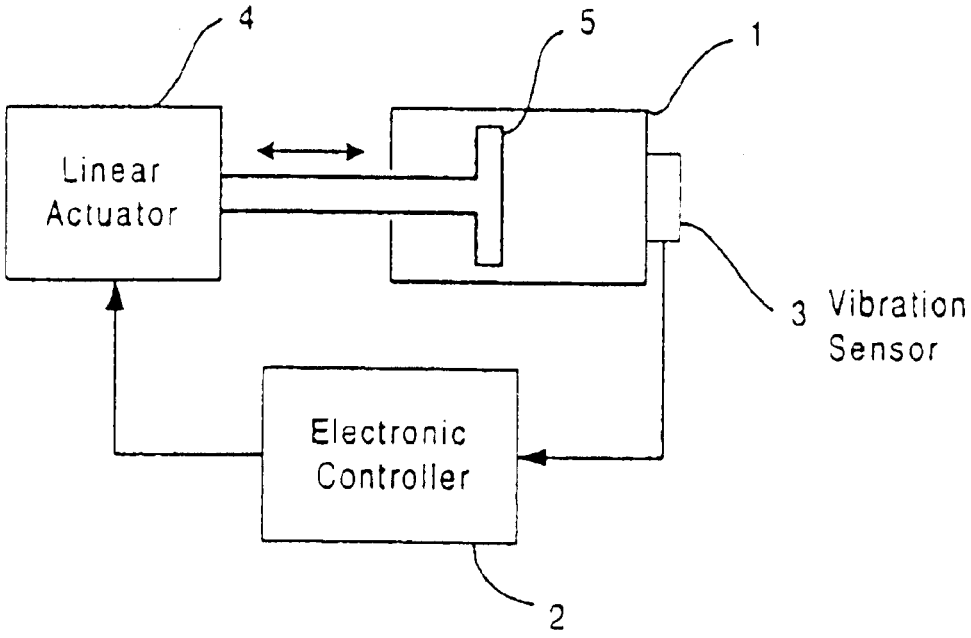

As shown in the FIGURE, a vibration sensor 3, for example a piezoelectric device, is mounted on a machine in the form of a pump, such that any end collision of reciprocation piston 5 is detected, for example on one end 6 of a pump cylinder 1. Vibration sensor 3 is electrically/electronically connected to a controller 2 in the form of an electronic circuit, for example a micro-processor. The controller 2 is electrically/electronically linked to a variable voltage driver 4 including an electromagnet which is itself mechanically linked to the piston 5 of the pump cylinder 1, to form a closed loop control system. The controller 2 interconnects the vibrator sensor 3 and the driver 4. The vibration sensor 3 can be mounted to an end 7 of the pump cylinder 1 opposite to that which the sensor 3 is shown mounted in the FIGURE.

In use, the controller 2 is set to deliver a gradually increasing voltage across the driver 4. This has the effect of gradually increasing the stroke length of the piston 5. Should the end of the piston 5 strike an end plate at either end 6, 7 of the pump cylinder 1, this is detected by the vibration sensor 3 which generates a signal which is transmitted to the controller 2. Receipt of the signal from the vibration sensor 3 then causes the controller 2 to reduce the drive voltage to the driver 4.

In the above described embodiment, the piston 5 is driven by a closed loop control system which includes a vibration sensor 3, a variable driver 4 and a controller 2 which is used to analyze the sensor output from the vibration sensor 3 to determine the drive voltage.

The vibration sensor 3 is effectively used to maximize the piston stroke by sensing any end point engagement of the piston 5 on the pump cylinder 1 and thereby avoid over driving the pump. The vibration sensor 3 is able to detect collision at either end 6, 7 of the pump cylinder 1, therefore the maximum stroke is achieved independent of any offsets in the system.

Although reference is made in the above-described embodiment to a variable voltage drive means, the drive means could be a variable current drive.

The benefits of the control means are:

- optimum performance of the machine is achieved through maximised stroke length.
- the closed loop control provides inherent compensation for mechanical load and power supply variations.
- the vibration sensor 3 is not intrusive to the pump 1 and preferably mounted to an exterior of the pump as shown in the Figure and therefore, not vulnerable to contamination or corrosive action.
- the vibration sensor 3 does not require accurate calibration or positioning, indeed the sensor may be mounted on any appropriate surface of the machine.
- the electronic controller may detect vibration sensor failure or detachment by monitoring the background vibration level from the sensor 3.
- the closed loop control provides inherent compensation for change in mechanical performance over time.
- the vibration sensor 3 is not intrusive to the pump cylinder 1 and preferably mounted to an exterior of the pump cylinder 1 as shown in the Figure and therefore, not vulnerable to contamination or corrosive action.

It will be understood that the embodiments described herein are exemplary of the present invention and that a person skilled in the art may make many variations and modifications without departing from the spirit and scope of the invention. All such modifications and variations are intended to be included within the scope of the invention as defined in the appended claims.

What is claimed is:

1. An apparatus comprising:

a cylinder having opposed ends;

a piston disposed for reciprocating movement between the opposed ends of the cylinder; drive means connected to he piston for providing the reciprocating movement of the piston;

sensor means in communication with said cylinder for sensing any contact of said piston and said opposed ends, and generating a contact signal representing said contact; and control means interconnecting said sensor means and said drive means, the control means adapted to receive said contact signal as a sole input signal and generate a control signal to said drive means to adjust reciprocating movement of the piston, wherein the sensor means, drive means and control means are connected in series.

2. The apparatus according to claim 1, wherein the drive means, the sensor means and the control means comprise:

a closed loop control system.

3. The apparatus according to claim 1, wherein the drive means is selected from the group consisting of a variable voltage drive and a current driver.

4. The apparatus according to claim 1, wherein said sensor means is mounted to an exterior of said cylinder.

5. The apparatus according to claim 1, wherein the sensor means, comprises:

a piezoelectric device.

6. The apparatus according to claim 1, wherein the apparatus is a vacuum pump.

7. A system for controlling a reciprocating apparatus having a cylinder, a piston adapted for reciprocating movement in the cylinder, and a driver for moving the piston, the system comprising:

sensor means mounted to said cylinder for generating a first signal representing contact between the piston and the cylinder: and control means interconnecting said sensor means and the driver, the control means responsive to the first signal to generate a second signal to the driver from said first signal as a sole input signal to control movement of the driver and the piston.

* * * * *